US005936360A

United States Patent [19]

Kaneko

[11] Patent Number: 5,936,360

[45] Date of Patent: Aug. 10, 1999

[54] BRIGHTNESS CONTROLLER FOR AND METHOD FOR CONTROLLING BRIGHTNESS OF A DISCHARGE TUBE WITH OPTIMUM ON/OFF TIMES DETERMINED BY PULSE WAVEFORM

[75] Inventor: Moriyoshi Kaneko, Shizuoka, Japan

[73] Assignee: Ivice Co., Ltd., Japan

[21] Appl. No.: 09/057,295

[22] Filed: Apr. 8, 1998

[30] Foreign Application Priority Data

Feb. 18, 1998 [JP] Japan ..... 10-036421

[51] Int. Cl.[6] ..... H05B 37/02

[52] U.S. Cl. ..... 315/307; 315/DIG. 7; 315/219

[58] Field of Search ..... 315/219, 307, 315/DIG. 7, 224

[56] References Cited

U.S. PATENT DOCUMENTS 4,700,113 10/1987 Stupp et al. ..... 315/219

4,933,612 6/1990 Bonin ..... 315/219

5,453,665 9/1995 Konopka ..... 315/219

*Primary Examiner*—Michael B Shingleton

*Attorney, Agent, or Firm*—Scully, Scott, Murphy & Presser

[57] ABSTRACT

An efficient brightness controller is disclosed, which can be applied to various discharge tubes different in length, diameters and/or the like. The controller includes a high frequency transformer 2 having a primary coil. First terminal (node $N_2$) of the primary coil is connected to a power supply $V_{DD1}$, and second terminal (node $N_1$) is connected to an output element 3. The controller also includes an amplifying circuit 6 for amplifying the waveform of the voltage at the node $N_2$. The controller further includes an ON-time/OFF-time control circuit 5 for setting the optimum ON time depending on the output voltage at the node $N_1$ and the output from the amplifier 6, and then adjusting the OFF time on the basis of the set optimum ON time.

25 Claims, 18 Drawing Sheets

BRIGHTNESS CONTROLLER FOR AND METHOD FOR CONTROLLING BRIGHTNESS OF A DISCHARGE TUBE WITH OPTIMUM ON/OFF TIMES DETERMINED BY PULSE WAVEFORM

BACKGROUND OF THE INVENTION

1. Field of the Invention

The present invention relates to a brightness controller for neon tubes, fluorescent lamps or other discharge tubes. In particular, the invention relates to a discharge tube brightness controller which can continuously control the brightness of the discharge tubes and drive the discharge tubes with low power dissipation.

2. Description of the Related Art

Brightness control is to change the light flux from a light source by adjusting the input to the source. It is possible to control the brightness of an incandescent lamp continuously between 100% (rated light flux) and 0% by varying the input voltage. Recently, in many cases, the incandescent lamp has been driven with pulses by a thyrister connected in series to the lamp. The ON time of the pulses is controlled to change the average current, controlling the brightness of the lamp. On the other hand, a discharge tube such as a neon tube and a fluorescent lamp has a narrow voltage range for stable discharge. It is therefore impossible to control the brightness of a discharge tube by controlling the input voltage. Normally, the input current is changed to control the discharge tube brightness. In this case, it is necessary to keep thermoelectrons emitted from the discharge tube electrodes heated specially. In general, a voltage which is higher than a certain value is input as pulses. The ON time of the pulses is changed to control the average current. This brightness control is performed by changing the ratio of the ON time to the OFF time at a constant frequency.

As well known, the impedance of the discharge tube which has not started to discharge varies greatly from that of the tube which has started to. As also known, the impedance of the discharge tube depends on the length and diameter of the tube, the input voltage and external factors. Therefore, the conditions for driving the discharge tubes are different for different tubes, and no general purpose continuous brightness controller is known. Even in a case where the input voltage of the discharge tube is driven with pulses, the range of stable discharge is limited. Therefore, practically, it is impossible to control the brightness of the discharge tube continuously over a wide dynamic range. In particular, it is difficult to control the brightness of a high voltage discharge lamp. Generally, the brightness of such a lamp can be controlled only in two, three or more steps. On detailed study of the transient response of the discharge tube being driven with pulses, it is found that the input voltage applied to the tube does not contribute all the time to discharge. In some cases, considerable components of such voltage is wasted as heat.

In particular, of the discharge tubes, neon tubes vary in length and diameter, and differ in impedance. In some cases, it was not possible to light or turn on all of the discharge tubes different in impedance which are connected to a particular lighting device, because the impedances and/or other discharging or luminous conditions vary tube by tube and a limited condition of a single lighting device cannot match these conditions. Each such discharge tube was turned on under conditions not matching with the impedance of the circuit including the tube, a high frequency transformer and an oscillating capacitor, and with the frequency of energy variation inherent in the circuit. Therefore, even if it was possible to turn on the discharge tubes, the efficiencies were generally low.

Because conventional brightness control is performed at a constant frequency, the ON time and the OFF time are related to each other, and the range of brightness control is narrow. In this case, because both the ON time and the OFF time change, it is impossible to keep the ON time constant. Consequently, the ON time becomes more and more deviate from the optimum value, lowering the efficiency of brightness control.

SUMMARY OF THE INVENTION

In view of the foregoing problems, it is an object of the invention to provide a brightness controller which enables various discharge tubes to emit light efficiently under optimum conditions even if the tubes differ in length and/or diameters.

It is another object of the invention to provide a brightness controller for discharge tubes with which desired brightness can be obtained efficiently for miscellaneous tubes having various lengths and diameters.

It is still another object of the invention to provide a brightness controller for continuously controlling the brightness of discharge tubes.

A brightness controller according to the invention includes a transformer having a primary coil and a secondary coil. The secondary coil is connected to a discharge tube. A first terminal (node $N_2$) of the primary coil is connected to an electric power supply. A second terminal (node $N_1$) of the primary coil is connected to the output electrode of an output element. The control electrode of the output element is connected to a gate circuit, which is connected to a control circuit. An amplifying circuit is connected between the control circuit and the first terminal (node $N_2$) of the primary coil of the transformer. By detecting a first and a second voltage waveforms at the first and second terminals (nodes $N_1$ and $N_2$) of the primary coil, respectively, the ON time and OFF time of the drive pulses input to the control electrode of the output element are controlled independently to adjust the brightness of the discharge tube.

The discharge tube may be a neon tube, a fluorescent lamp or another electric discharge tube which can light at a high frequency. The discharge tube may also be a lamp for backlighting the liquid crystal used in a computer display.

The output element may be a semiconductor switching element such as a junction field-effect transistor (JFET), a MOS field-effect transistor (MOSFET), a bipolar transistor (BJT), an insulated gate bipolar transistor (IGBT), a static induction transistor (SIT), a static induction thyrister (SI thyrister) or another power device. The output element may also be a high electron mobility transistor (HEMT), a heterojunction bipolar transistor (HBT) or another compound semiconductor switching element.

The amplifying circuit may detect distortion of the first voltage waveform at the node $N_2$, and decide an optimum value of the ON time of the drive pulses. More specifically, the ON time may be preset provisionally at a shorter value, and thereafter set at an optimum value by being lengthened gradually with care taken so that no spike peak corresponding to the waveform distortion may be detected in the first voltage waveform amplified by the amplifying circuit. If distortion is detected in the first voltage waveform, the ON time is too long, and a part of the voltage output from the output element does not contribute to discharge, but is dissipated as extra heat energy. In this case, the ON time is shortened to eliminate the useless energy.

As stated earlier, the impedance of a discharge tube which is emitting light varies greatly from that of the tube not emitting light. The brightness controller of the present invention may also include a capacitor connected between the first and second terminals. This capacitor and the primary coil of the transformer may form an LC resonance circuit, which is coupled electromagnetically to the circuit consisting of the secondary coil of the transformer and the discharge tube. These circuits form a system which is a very complicated LC resonance circuit. The impedance of the system varies periodically. For efficient light emission from the discharge tube, it is necessary to drive the tube by operating the output element with the pulse characteristic which matches with the energy variation in the complicated resonance circuit. A system consisting of the discharge tube, the transformer and the capacitor has its inherent frequency of energy variation. There is an optimum value of the ON time for driving the discharge tube.

FIGS. 17A and 17B of the accompanying drawings show the transient responses of the light emissions from the discharge tube to the electric pulses input to the tube of the present invention. FIG. 17A shows transient response of the discharge tube in a case where the OFF time is relatively short. FIG. 17B shows transient response of the tube in a case where the OFF time is longer. The light intensity data were measured by a phototransistor receiving the light from the discharge tube. "The input voltages of the discharge tube" mean the voltages at the primary coil of the transformer connected to the tube. In FIGS. 17A and 17B, the input voltages are shown as downward (negative polarity) pulses. FIGS. 17A and 17B show voltage changes at the second terminal (node $N_1$) of the primary coil of the transformer which is connected to the output element. These figures show that, when the output element turns on, the potential at the node $N_1$ drops from a supply voltage $V_{DD1}$ to the ground voltage. The intensity of the light emitted from the discharge tube is shown as downward. When the output element turns on, high voltage is generated in the secondary coil of the transformer, and the discharge tube discharges. The light emission intensity of the discharging tube increases gradually, becomes the maximum at a certain time, and thereafter decreases gradually. In general, however, the time when the emission intensity of the discharge tube becomes the maximum does not coincide with the trailing edge of the input voltage of the tube. There is a time difference $\Delta t_0$ between the time and the edge. The difference $\Delta t_0$ tends to be greater when the OFF time is longer as shown in FIG. 17B than when the OFF time is shorter as shown in FIG. 17A. Even though the same input voltage is applied, the emission intensity is weaker when the OFF time is longer than when the OFF time is shorter. Likewise, when the ON time is varied, the time difference $\Delta t_0$ changes depending on the ON time. If the ON time is too long, the difference $\Delta t_0$ is a negative value. In this case, even though the input voltage is applied to the discharge tube, the emission intensity starts to decrease precedently. Thus, the transient characteristic of light emission from the discharge tube does not correspond exactly to the waveform of the pulses input to the tube, but changes complexly with a time delay and a time constant depending on the characteristic (ON time/OFF time) of the input pulses.

As shown in FIGS. 17A and 17B, the light emission from the discharge tube has such a transient characteristic that the light emission intensity becomes the maximum at a certain time and lowers thereafter. If the input voltage is kept applied while the emission intensity is lowering, the luminous efficiency lowers. Therefore, in conclusion, for more efficient brightness control in the high frequency lighting of the discharge tube, it is necessary for the ON time to be within a predetermined range. In other words, it is found that the longer the ON time of the discharge tube drive voltage is, not necessarily the better, but if the ON time is too long, the luminous efficiency of the tube lowers, and energy is wasted.

FIG. 18 of the drawings shows the relationship between the ON time of the output element and the illuminance of the discharge tube. It is found from FIG. 18 that, when the discharge tube is driven for an ON time longer than a certain value, the illuminance decreases as the ON time increases. More ON time than is necessary mismatches the output impedance of the output element and the impedance of the circuit consisting of the transformer, the discharge tube and the capacitor, distorting the output voltage of the element. Therefore, by setting the ON time in such a manner that the voltage is not distorted, it is possible to drive the discharge tube and control the brightness of the tube at a high luminous efficiency.

The shorter the ON time is, not necessarily the better. It is preferable that the ON time be set at a value matching with the natural frequency and/or the impedance of the LC resonance circuit which consists of the primary coil of the transformer and the capacitor connected in parallel to this coil. This can be done by setting within a predetermined range the time difference $\Delta t$ between the trailing edge of an output voltage pulse at the output electrode (node $N_1$) of the output element and the trailing edge of a gate drive pulse at the control electrode of the element. Of course, the control electrode of the output element means the gate electrode if the element is a JFET, a MOSFET, an IGBT, an SIT, an SI thyrister or the like. The control electrode means the base electrode if the output element is a BJT. The ON time may be set so that the time difference $\Delta t$ is less than 3 microseconds. It is therefore preferable that the turn-off time which is inherent in the output element be sufficiently shorter than 3 microseconds. If the time difference $\Delta t$ is within a certain range, the repetition period of energy variation and the impedance of the LC resonance circuit, inclusive of the impedance of the discharge tube, match with the variation of the output voltage from the output element and the impedance of the element. This stores and transfers energy most effectively. It is therefore possible to make the discharge tube emit light at the maximum efficiency.

If, after the optimum value of the ON time is thus decided, the OFF time is decided for desired brightness, with the optimum ON time fixed. Thus, it is possible to control the brightness of the discharge tube at the maximum efficiency.

It is also possible to determine the upper limit of brightness by determining the minimum value of the OFF time with the output from the amplifying circuit. If the natural frequency of energy variation of the LC resonance circuit comes not to match with the frequency of the voltage output from the output element, the efficiency lowers. It is therefore preferable that the OFF time should not be shorter than a certain value. If it is possible to determine the minimum value of the OFF time, it is possible to control the brightness with a high efficiency maintained. This can be judged simply by detecting an inherent spike peak being present in or absent from the output from the amplifying circuit.

More preferably, the control circuit of the present invention should include a switching waveform detecting circuit, an ON-time comparison circuit, an ON-time reference circuit, an ON-time adjustment circuit, an OFF-time reference circuit and a brightness adjusting circuit.

The voltage at the node $N_1$, which is output from the output element, is input to the switching waveform detecting circuit. The output from this detecting circuit is input to the ON-time comparison circuit, which compares the time difference $\Delta$ t between the trailing edge of a pulse at the output electrode of the output element and the trailing edge of a pulse at the control electrode of the element. The result of comparison is input to the ON-time adjustment circuit, which is connected to the ON-time reference circuit to set the optimum value of the ON time.

The OFF-time reference circuit is connected to the ON-time adjustment circuit and the brightness adjustment circuit. By adjusting the OFF time with the brightness adjustment circuit after setting the ON time at a predetermined time, it is possible to control the brightness of the discharge tube at the maximum efficiency. The OFF-time reference circuit inputs predetermined drive pulses through the gate circuit to the control electrode of the output element.

In accordance with the present invention, it is easy to decide the optimum ON time even if the discharge tubes as loads differ in length, diameter and/or the like. It is therefore possible to light various discharge tubes at high luminous efficiencies.

In accordance with the present invention, it is possible to change the OFF time for desired brightness with the ON time fixed at the optimum value. It is therefore possible to control the brightness efficiently.

In accordance with the present invention, the optimum ON time is decided by being set provisionally at a rather short value and lengthened thereafter. Therefore, no extra energy is wasted.

BRIEF DESCRIPTION OF THE DRAWINGS

A preferred embodiment of the invention will be described below with reference to the accompanying drawings, in which.

DETAILED DESCRIPTION OF A PREFERRED EMBODIMENT

Figure 1:
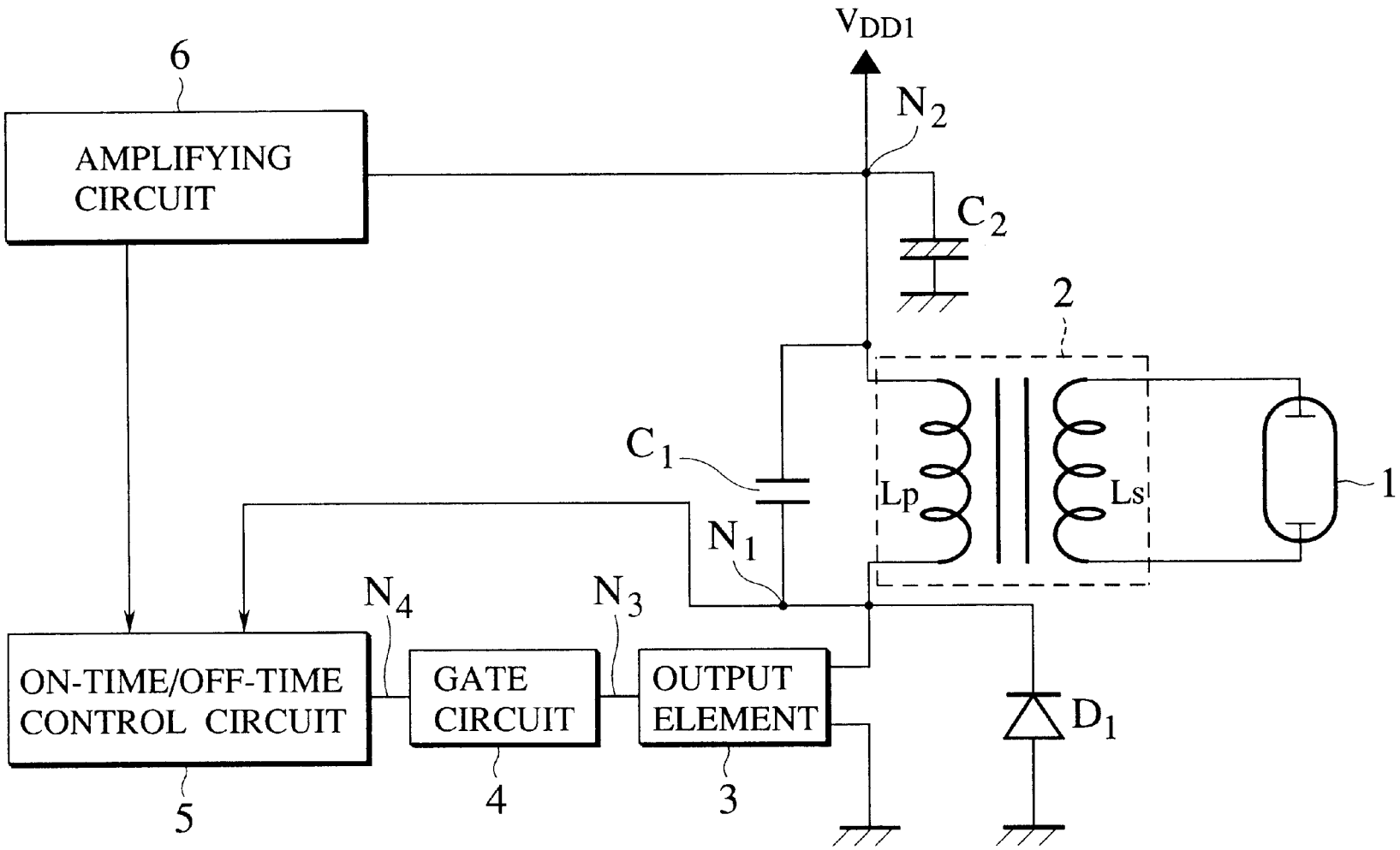
FIG. 1 is a block diagram of a brightness controller according to the embodiment for discharge tubes.

In the drawings, the same or similar parts or components are assigned the same or similar reference numerals. It should be noted that the drawings show a typical embodiment of the invention.

The brightness controller shown in FIG. 1 includes a discharge tube 1, a transformer 2 such as a high frequency transformer and an output element 3 such as the semiconductor switching elements. The brightness controller of the present invention also includes a gate circuit 4 for applying a predetermined gate current or a predetermined gate voltage to the control electrode of the output element 3. The brightness controller further includes a control circuit (an ON-time/OFF-time control circuit) 5 for supplying the gate circuit 4 with drive pulses having a predetermined ON time and a predetermined OFF time. The transformer 2 has a primary coil $L_P$ and a secondary coil $L_S$, which is connected to the discharge tube 1. A first terminal of the primary coil $L_P$ is connected to a power supply (a first direct voltage source) $V_{DD1}$, which may be a commercial DC power supply rectified by a diode bridge or the like. A second terminal of the primary coil $L_P$ is connected to the output terminal of the output element 3. The voltage of the power supply $V_{DD1}$ may be 12 volts, for example. The node $N_2$ between the power supply $V_{DD1}$ and the primary coil $L_P$ is connected to a smoothing capacitor $C_2$. An oscillating capacitor $C_1$ is connected between the first and second terminals of the primary coil $L_P$. The coil $L_P$ and the capacitor $C_1$ form an LC resonance circuit. A freewheeling diode $D_1$ is connected in parallel to the output element 3. It is important to this brightness controller that the second voltage waveform at the node $N_1$ between the second terminal of the primary coil $L_P$ and the output element 3 and the first voltage waveform at the node $N_2$ between the power supply $V_{DD1}$ and the first terminal of this coil $L_P$ be fed back to the ON-time/OFF-time control circuit 5. The optimum ON time is set by monitoring the second voltage waveform at the node $N_1$, which is output from the output element 3, and the first voltage waveform or the supply line voltage waveform (SLVW) at the node $N_2$, which is output from the power supply $V_{DD1}$. By varying the OFF time while keeping the ON time at a constant value, it is possible to obtain desired brightness of the discharge tube 1.

Specifically, the brightness of the discharge tube 1 is adjusted by a procedure including:

(FIRST STEP) presetting the ON time at a rather short value, which may be 15–20 microseconds, then setting the ON time at an optimum value by gradually lengthening the preset time while monitoring the SLVW at the node $N_2$, which is output from the power supply $V_{DD1}$;

(SECOND STEP) adjusting the OFF time for the desired brightness while maintaining the set optimum value of the ON time.

The OFF time may be set at a value which is 30–40 times as long as the ON time. The ON time and the OFF time of the pulses input to the gate circuit 4 are set at desired values independently of each other and arbitrarily. Therefore, as the brightness is adjusted, the pulse repetition frequency changes.

Figure 2:
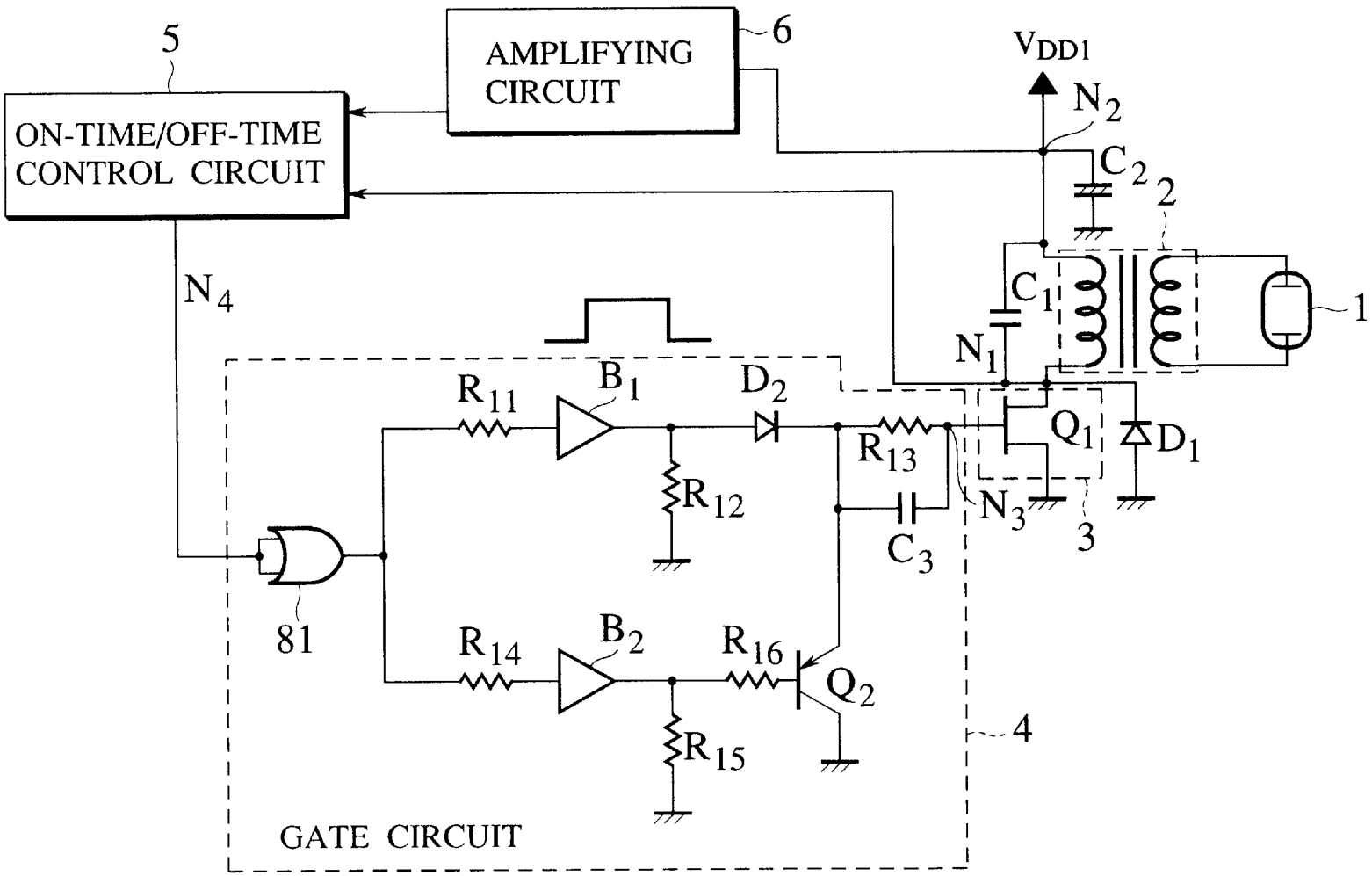
FIG. 2 is another block diagram of the brightness controller, showing details of the output element and gate circuit.

The output element 3 may be a JFET, a MOSFET, a BJT, an IGBT, an SIT, an SI thyrister, an HEMT or another semiconductor switching element. FIG. 2 shows details of the gate circuit 4 for a JFET $Q_1$ serving as the output element 3. The gate pulses from the ON-time/OFF-time control circuit 5 applied to the JFET $Q_1$ through the resistor $R_{11}$, buffer amplifier $B_1$, resistor $R_{12}$, diode $D_2$, resistor $R_{13}$ and capacitor $C_3$ of the gate circuit 4.

This gate circuit 4 includes an npn bipolar transistor $Q_2$. The gate circuit 4 draws current from the gate of the JFET $Q_1$ to turn off the FET $Q_1$ quickly. The driving pulses from the ON-time/OFF-time control circuit 5 are applied to the base of the transistor $Q_2$ through a resistor $R_{14}$, a buffer amplifier $B_2$ and resistors $R_{15}$ and $R_{16}$. When the driving pulses are low, the transistor $Q_2$ is conductive, drawing the carriers accumulated in the gate of the JFET $Q_1$. When the driving pulses are high, the transistor $Q_2$ is off, and therefore the driving pulses from the control circuit 5 are applied effectively to turn on the JFET $Q_1$. The gate circuit 4 may be designed depending on the performance and characteristics of the output element 3, and is not limited to what is exemplified in FIG. 2.

Figure 3:
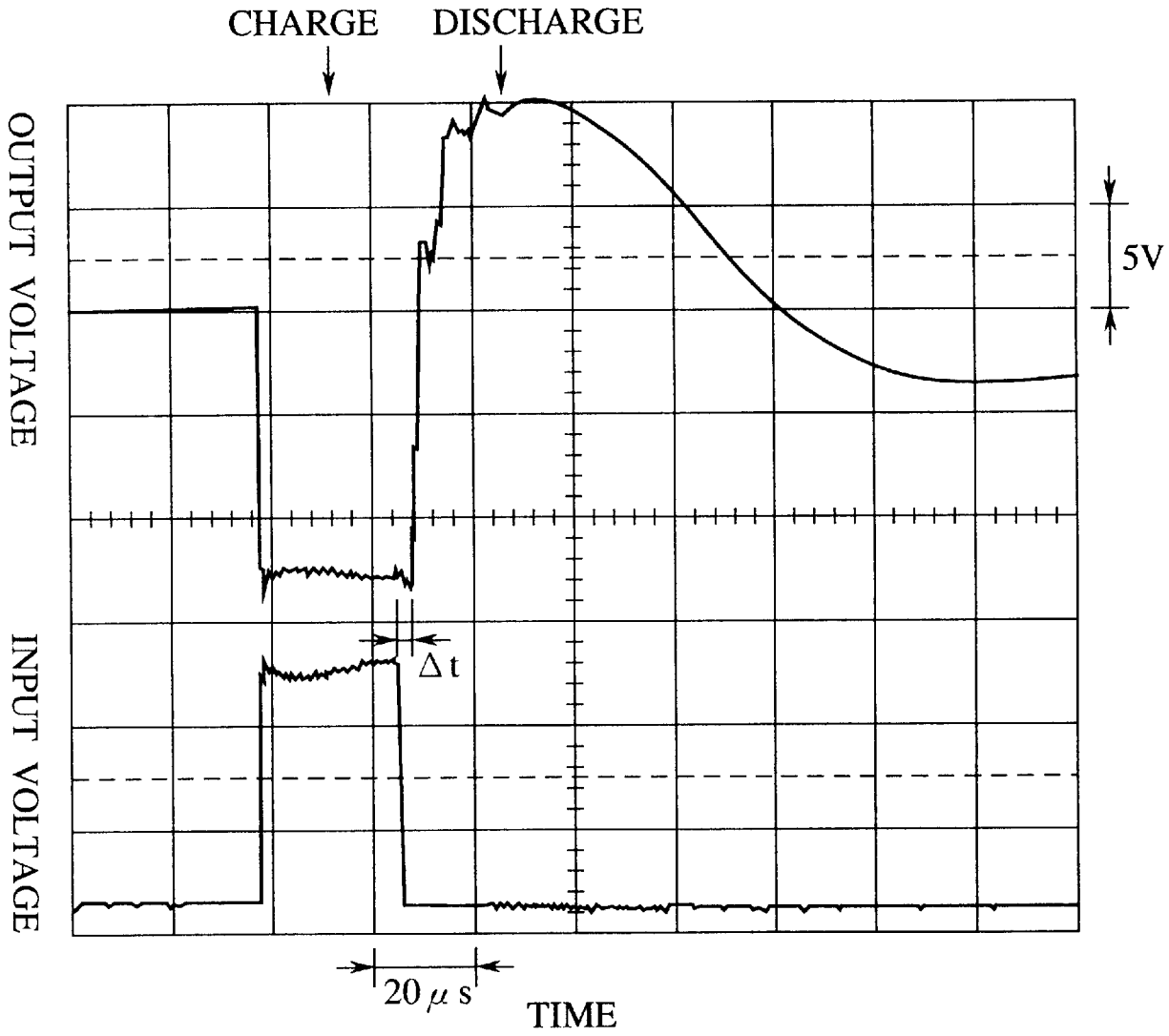
FIG. 3 is a chart showing the relationship between the input voltage to and output voltage from the output element.

FIG. 3 shows the relationship between the time variation of the input voltage at the node $N_3$ between the gate electrode (control electrode) of the JFET $Q_1$ and the gate resistor $R_{13}$ and the time variation of the output voltage at the node $N_1$ connected to the output electrode of the JFET $Q_1$. When the high voltage is applied to the gate electrode of the JFET $Q_1$, the JFET $Q_1$ is turned on, grounding the node $N_1$. As the JFET $Q_1$ is turned on, the oscillating capacitor $C_1$ is charged. When a certain time has passed after the capacitor $C_1$ has been charged, the polarity is inverted. Namely, the JFET $Q_1$ is turned off and the capacitor $C_1$ starts to discharge.

Figure 4:
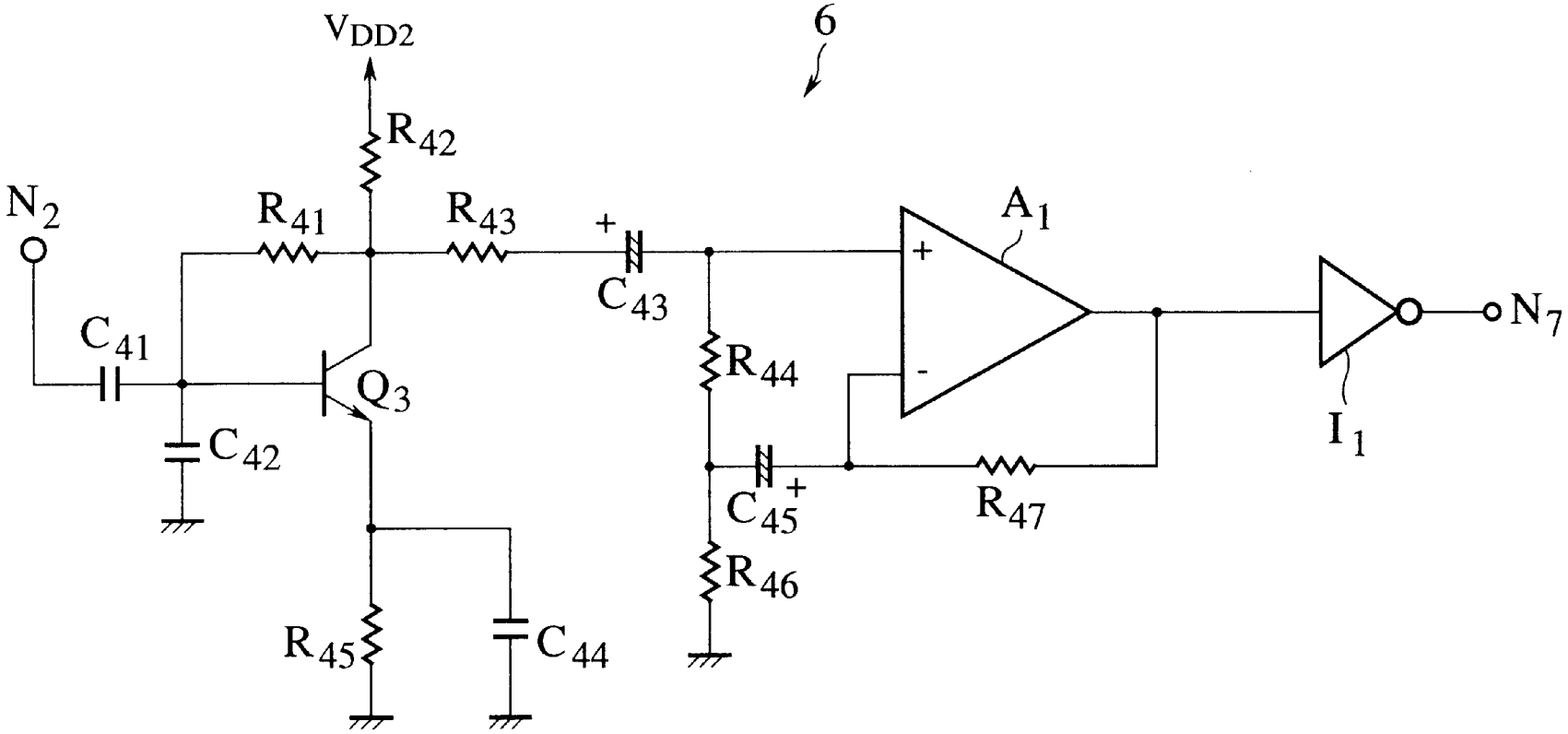
FIG. 4 is a circuit diagram of the supply line voltage waveform (SLVW) amplifying circuit in the brightness controller.

FIG. 4 shows details of the amplifying circuit 6, or a supply line voltage waveform (SLVW) amplifying circuit for monitoring the first voltage waveform (SLVW) at the node $N_2$. The circuit 6 includes an npn bipolar transistor $Q_3$ and an operational amplifier $A_1$. The collector electrode of the transistor $Q_3$ is connected through a resistor $R_{42}$ to a power supply (second power supply) $V_{DD2}$, the voltage of which may be 8 volts, for example. The first voltage waveform at the node $N_2$, which is applied by capacitive coupling through a capacitor $C_{41}$, is converted into the base current of the transistor $Q_3$ by a resistor $R_{41}$. In this way, the first voltage waveform at the node $N_2$ is AC-amplified by the transistor $Q_3$, and further amplified by a multiplying factor of 100 by the operational amplifier $A_1$.

Figure 5:
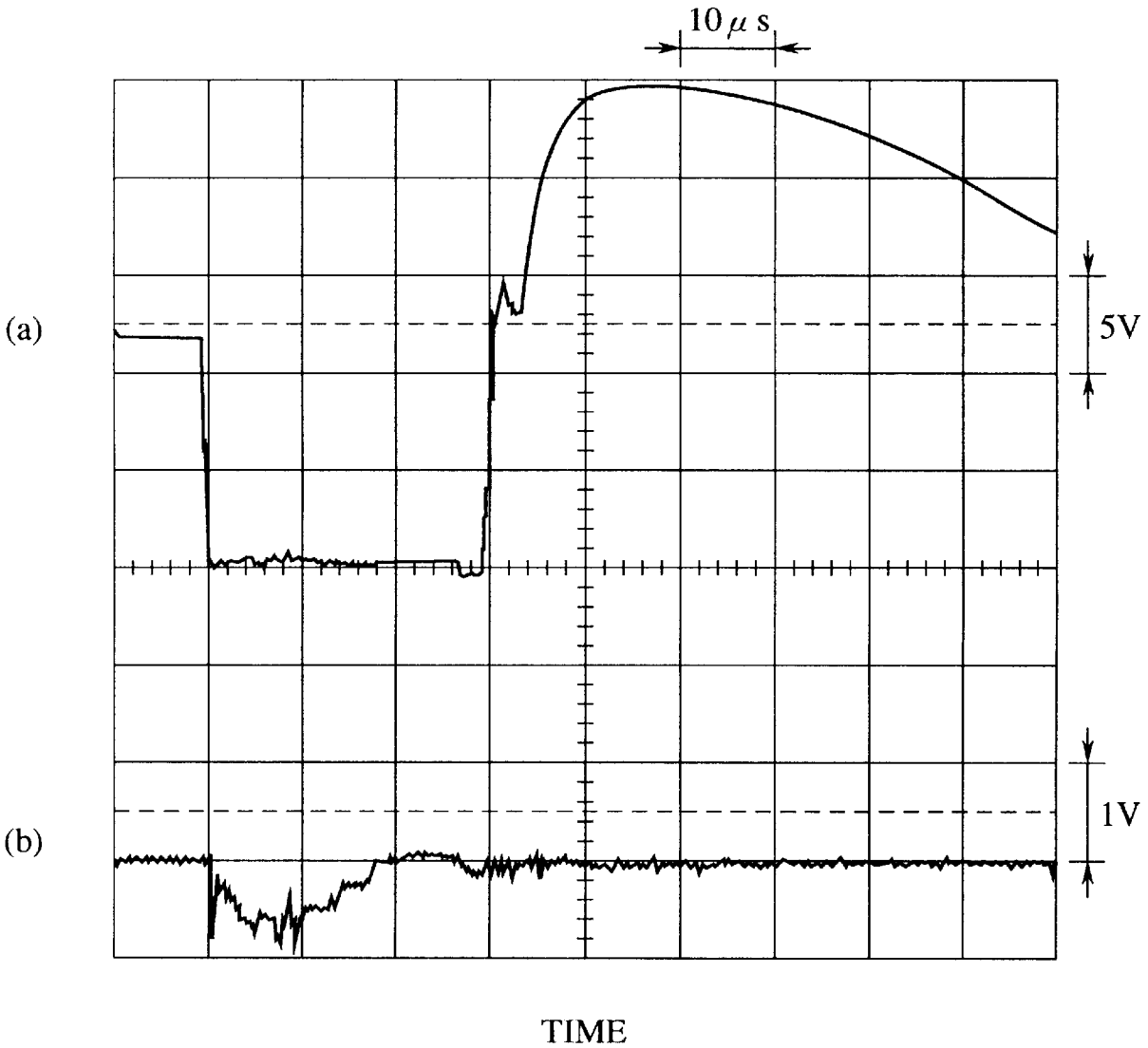
FIG. 5 is a chart showing the relationship between the output voltage (a) at node $N_1$ from the output element and the supply line voltage waveform (SLVW) (b) at node $N_2$.

FIG. 5(*b*) shows the SLVW (the first voltage waveform) at the node $N_2$ which was AC-amplified by the npn bipolar transistor $Q_3$. FIG. 5(*a*) shows the second voltage waveform of the resultant voltage at he node $N_1$, which was output from the output element 3. When the output element 3 (JFET $Q_1$) is conductive and the discharge tube 1 starts to discharge, the impedance changes. FIG. 5(*a*) shows how the impedance change affects the SLVW.

Figure 6:
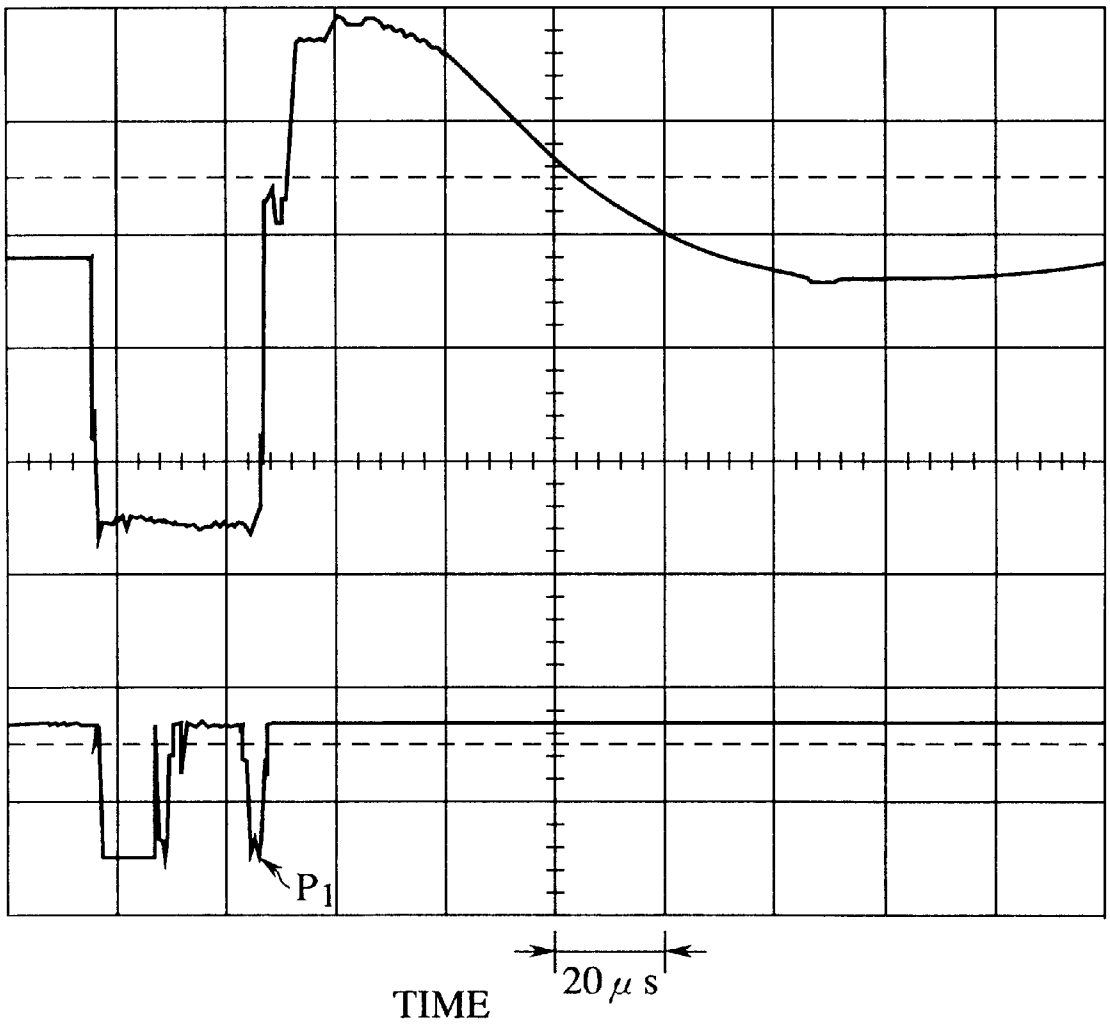
FIG. 6 is a chart showing the SLVW (b) amplified when the output voltage (a) from the output element has no distortion.
Figure 7:
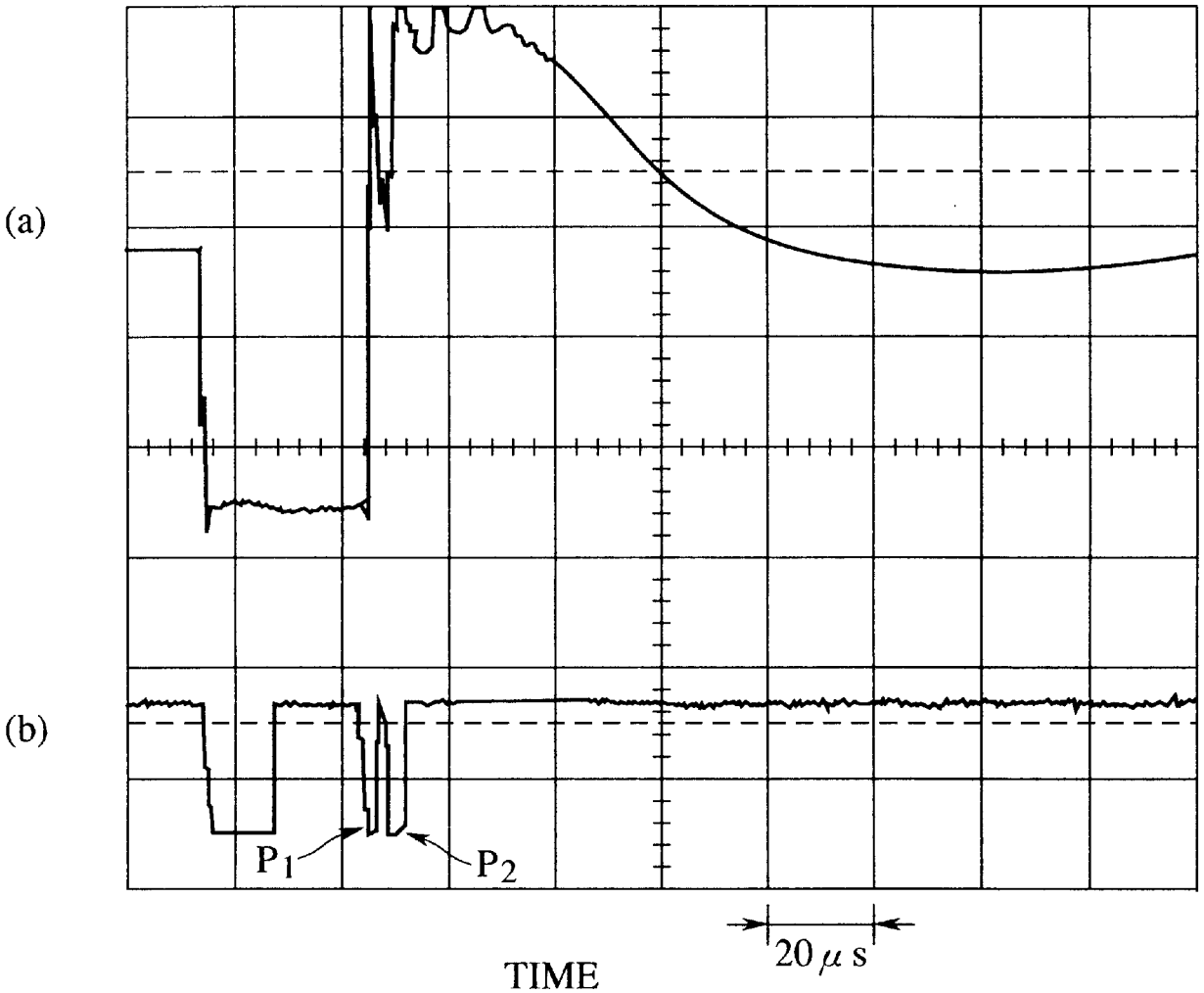
FIG. 7 is a chart showing the SLVW (b) amplified when the ON time of the output voltage (a) is too long.

FIGS. 6(*b*) and 7(*b*) show the SLVW (the first voltage waveform) at the node $N_2$ which was AC-amplified by the npn bipolar transistor $Q_3$ and further amplified by the multifying power of 100 by the operational amplifier $A_1$. FIGS. 6(*a*) and 7(*a*) show the second voltage waveforms at the node $N_1$, which was output from the output element 3. In FIG. 6(*b*), one spike peak $P_1$ appears at the end of the ON time of the transistor $Q_1$. In FIG. 7(*b*), two spike peaks $P_1$ and $P_2$ appear. FIG. 7(*b*) shows that, because the ON time $t_{ON}$ was too long, the SLVW at the node $N_2$ distorted, and the peak $P_2$ appeared. It is therefore necessary to set such an ON time that the peak $P_2$ does not appear. Practically, the ON time $t_{ON}$ is set provisionally at a little short value of about 15–20 microseconds at first. Then, the provisionally set time $t_{ON}$ is made gradually longer. If the ON time $t_{ON}$ is set at a value just before the appearance or presence of distortion as shown in FIG. 7(*b*), this value is the optimum ON time $t_{ON}$. That is to say, with reference to FIG. 3, it is possible to set the ON time $t_{ON}$ at the optimum value by adjusting the time $t_{ON}$ so that the time difference $\Delta t$ between the trailing edge of the input voltage (gate voltage) to the output element 3 and the trailing edge of the output voltage (drain voltage) from this element falls within a predetermined range, which may be 0–3 microseconds.

The optimum ON time $t_{ON}$ also depends on the supply voltage $V_{DD1}$. Typically, if $V_{DD1}$ is 10 volts, $t_{ON}$ may be 28–30 microseconds, and if $V_{DD1}$ is 14 volts, $t_{ON}$ may be 23–24 microseconds.

Figure 8A:
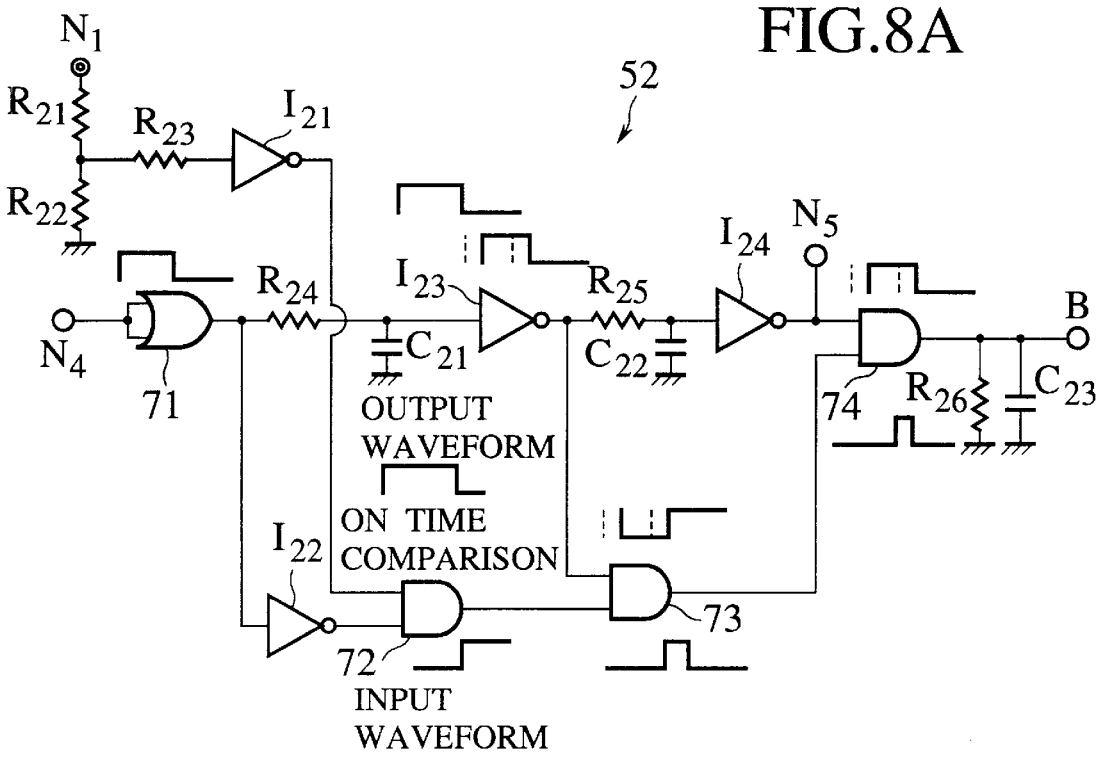
FIG. 8A is a circuit diagram showing a part of the ON-time comparing circuit in the brightness controller.
Figure 8B:
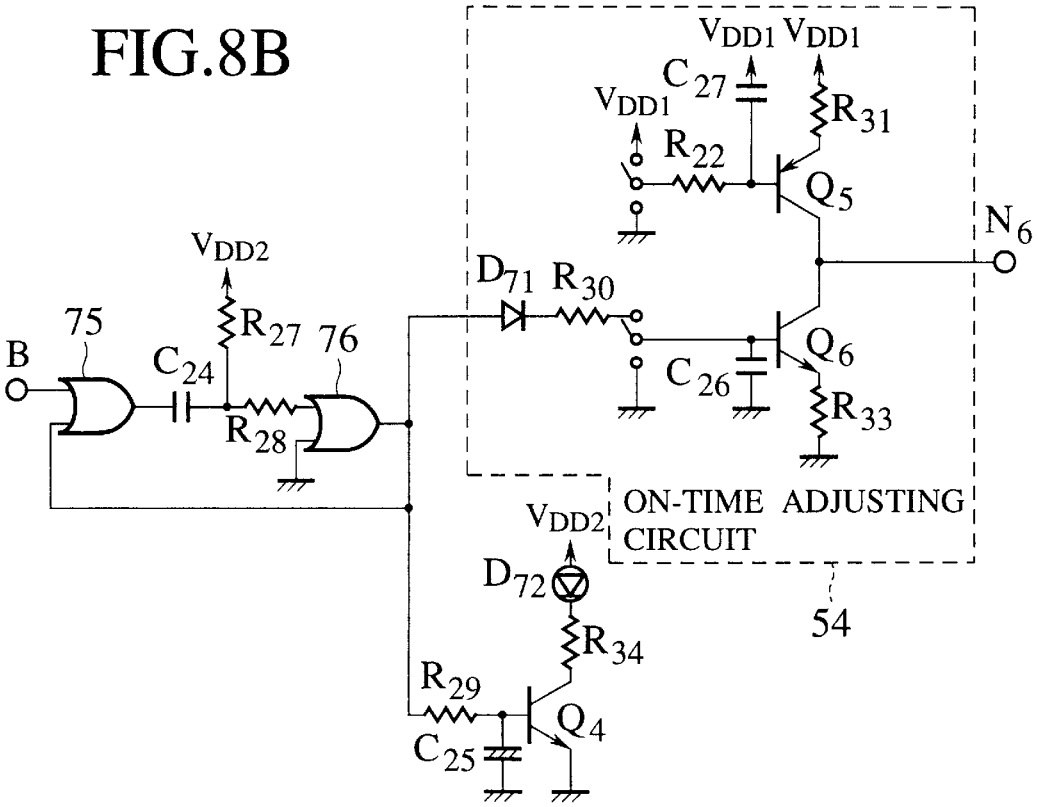
FIG. 8B is a circuit diagram showing the rest of the ON-time comparing circuit with an ON-time adjusting circuit.

FIGS. 8A and 8B show an ON-time comparison circuit 52 for comparing the trailing edge of the voltage at the node $N_4$ which is input to the output element 3 and the trailing edge of the voltage at the node $N_1$, which is output from this element. The signal at the node $N_1$ is inverted by an inverter $I_{21}$. The signal at the node $N_4$ is inverted by inverters $I_{22}$ and $I_{23}$. The signals from the inverters $I_{21}$ and $I_{22}$ are input to an AND circuit 72. The logical production (AND) from the circuit 72 and the signal from the inverter $I_{23}$ are input to an AND circuit 73. The signal from the inverter $I_{23}$ is further inverted by an inverter $I_{24}$. The logical production (AND) from the AND circuit 73 and the signal from the inverter $I_{24}$ are input to an AND circuit 74. As a result, if the time difference $\Delta t$ between the trailing edges is judged to be more than 3 microseconds, the light emitting diode $D_{72}$ lights, indicating that the ON time $t_{ON}$ is short. As shown in FIG. 8B, the ON-time comparing circuit 52 is connected to an ON-time adjusting circuit 54.

Figure 9:
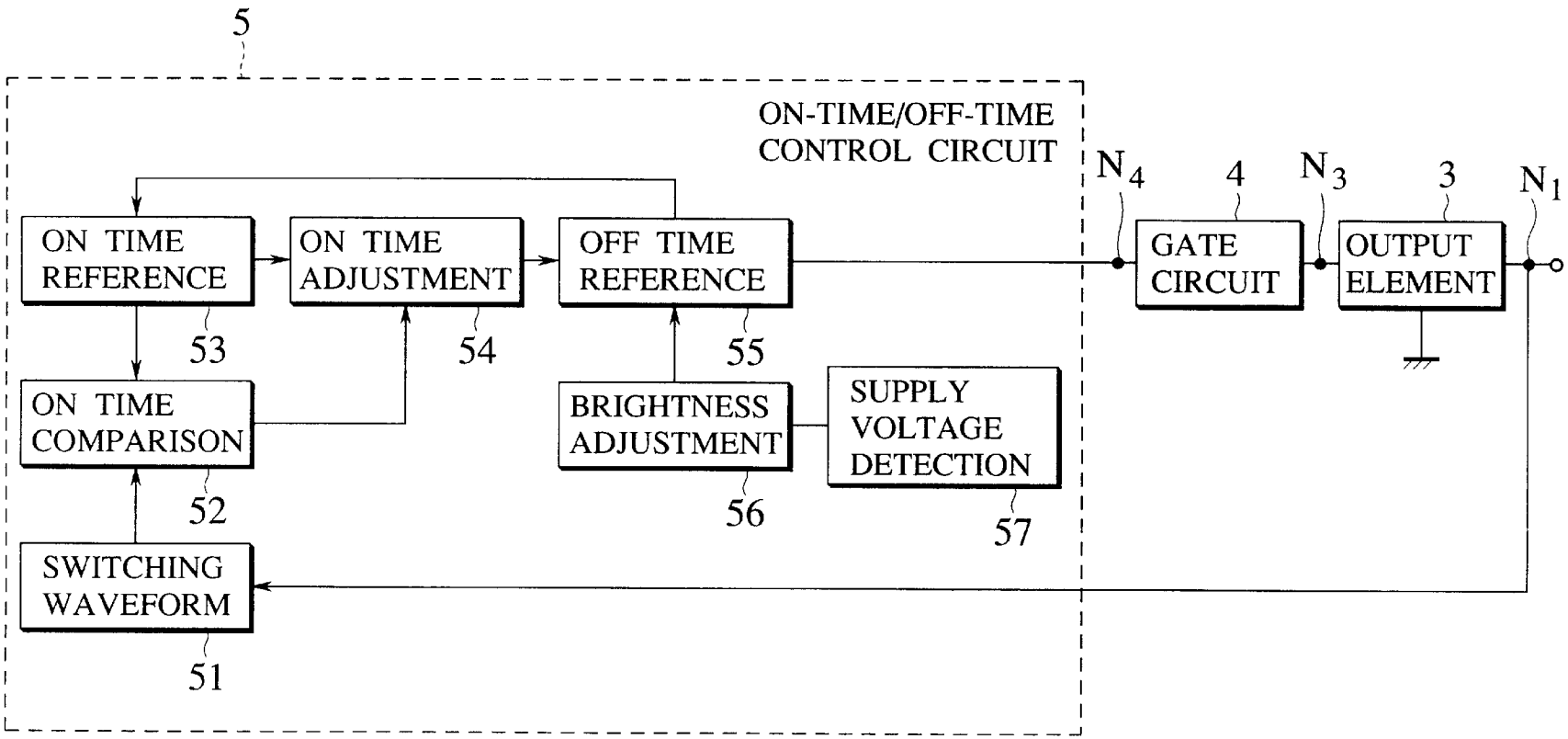
FIG. 9 is a block diagram showing details of the ON-time/OFF-time control circuit in the brightness controller.

FIG. 9 shows details of the ON-time/OFF-time control circuit 5, which includes a switching waveform detecting circuit 51. The switching waveform detecting circuit 51 is connected to the ON-time comparison circuit 52, which is connected to the ON-time adjustment circuit 54. The adjustment circuit 54 is connected to an OFF-time reference circuit 55, which is connected to an ON-time reference circuit 53 and a brightness adjustment circuit 56. The adjustment circuit 56 is connected to a supply voltage detection circuit 57. The ON-time reference circuit 53 is connected to the ON-time comparison circuit 52 and ON-time adjustment circuit 54.

Figure 10:
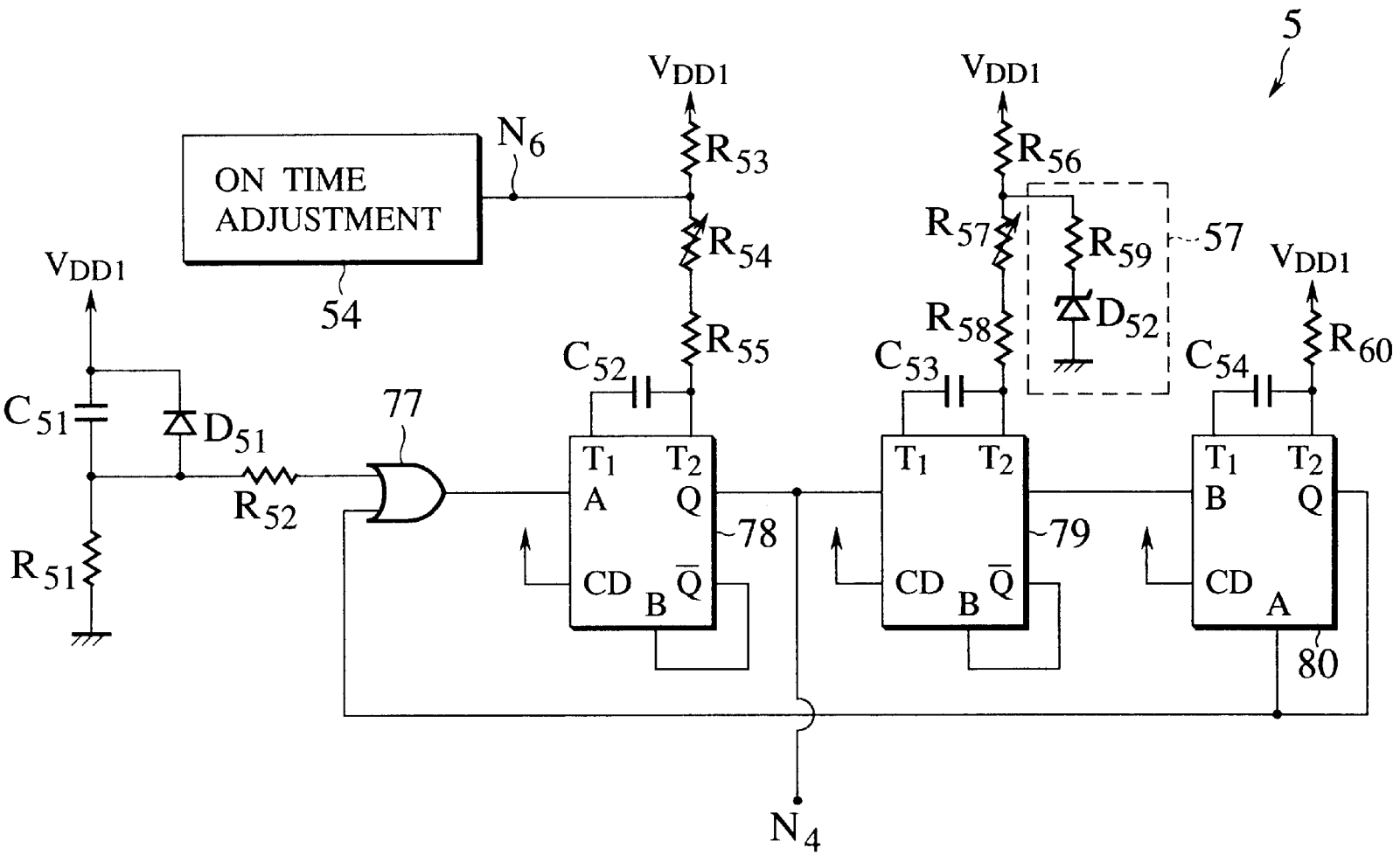
FIG. 10 is a further detailed diagram of the ON-time/OFF-time control circuit.

FIG. 10 shows the ON-time/OFF-time control circuit 5 in more detail, which includes three flip-flops 78, 79 and 80 connected in series. Trigger terminals of the flip-flops 78, 79 and 80 are connected to resistors $R_{53}$, $R_{54}$, $R_{55}$, $R_{56}$, $R_{57}$, $R_{58}$ and $R_{60}$. The flip-flops 78 and 79 function as the ON-time reference circuit 53 and OFF-time reference circuit 55, respectively. It is possible to adjust the ON time by varying the resistance of the resistor $R_{54}$ connected to the trigger terminal $T_2$ of the flip-flop 78, or with the output from the ON-time adjustment circuit 54, which is input to the node $N_6$ between the resistors $R_{53}$ and $R_{54}$.

By varying the resistance of the resistor $R_{57}$ connected to the trigger terminal $T_2$ of the flip-flop 79, it is possible to change the OFF time, adjusting the brightness. Connected to the node between the resistors $R_{56}$ and $R_{57}$ is the supply voltage detection circuit 57, which consists of a Zener diode $D_{52}$ and a resistor $R_{59}$. Thus, the three flip-flops 78, 79 and 80 in series control the ON time and OFF time independently to generate optimum pulses for driving the discharge tube 1. The output from the last-stage flip-flop 80 is input through an OR circuit 77 to the first-stage flip-flop 78 to determine the pulse frequency, stably generating pulses of this frequency.

With the optimum value of the ON time maintained, the OFF time $t_{OFF}$ is adjusted for desired time interval corresponding to the brightness of the discharge tube 1. Typically, if $V_{DD1}$ is 10 volts, $t_{OFF}$ may be 250–450 microseconds, and if $V_{DD1}$ is 14 volts, $t_{OFF}$ may be 450–850 microseconds.

It is preferable that the OFF time $t_{OFF}$ should not be shorter than a certain time interval. If the OFF time becomes shorter than the time constant of the resonance circuit consisting of the oscillating capacitor $C_1$ and the primary coil $L_P$, this circuit becomes insufficient to exchange energy between the electric field of its capacitor $C_1$ and the magnetic field of its inductor $L_P$. As a result, the luminous efficiency starts to lower. The OFF time $t_{OFF}$ should not be shorter than its limit value (lower limit of the OFF time) at which the luminous efficiency starts to lower. It is possible to decide the lower limit of the OFF time $t_{OFF}$ by monitoring the SLVW at the node $N_2$.

Figure 11:
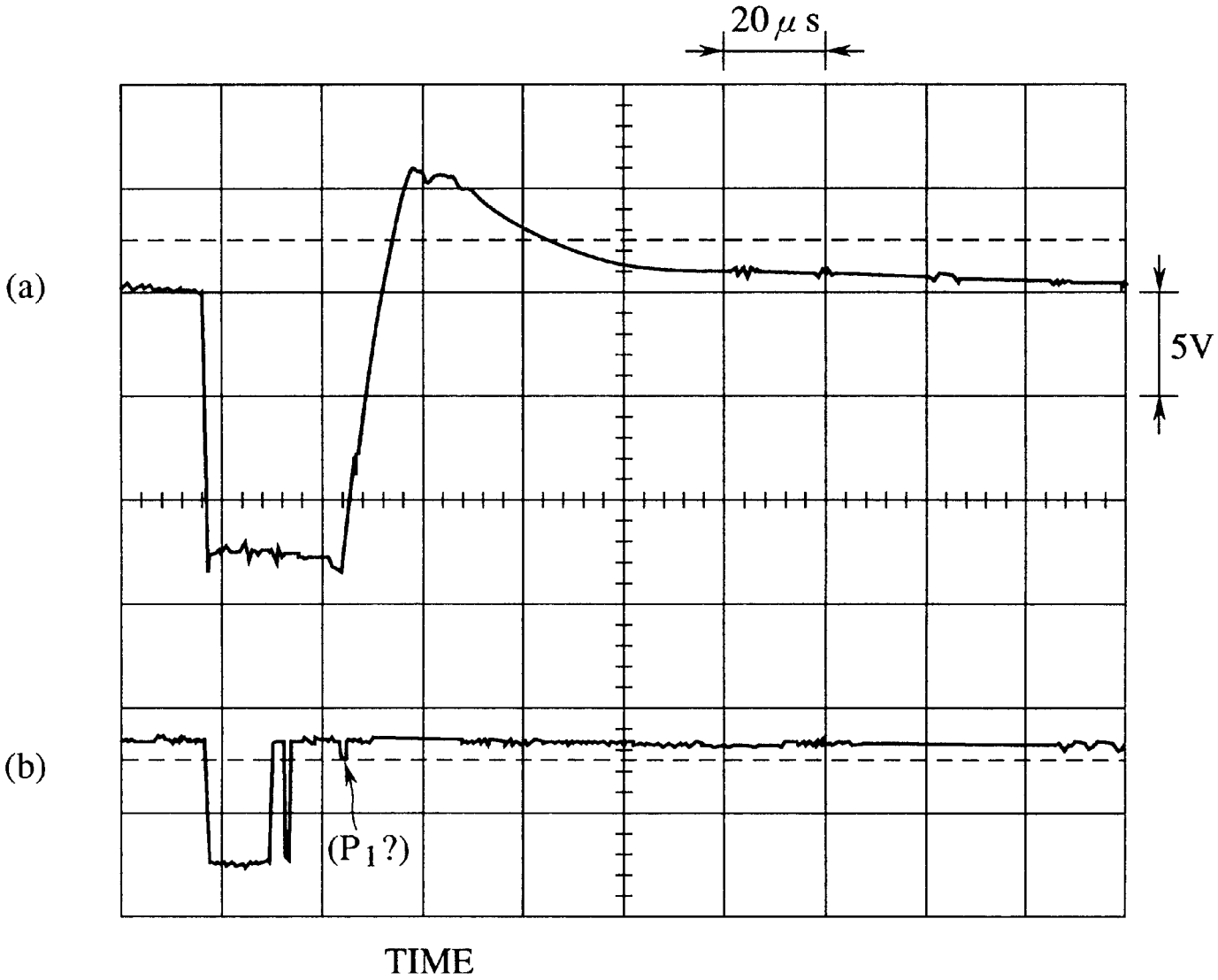
FIG. 11 is a chart showing the SLVW appearing when the OFF time is too short.

FIG. 11 shows waveforms which are characteristic when they approach the lower limit of the OFF time $t_{OFF}$. FIG. 11(*a*) shows the second voltage waveform at the node $N_1$, which is output from the output element 3. FIG. 11(*b*) shows the first voltage waveform (SLVW) at the node $N_2$ which is amplified by the multifying power of 100. As apparent in comparison with FIG. 6(*b*), the spike peak $P_1$ near the trailing edge which is seen in FIG. 6(*b*) is small and has almost vanished or disappeared. This indicates that, because the OFF time $t_{OFF}$ has become shorter than the time constant of the resonance circuit consisting of the oscillating capacitor $C_1$ and the primary coil $L_P$, this circuit has become insufficient to fully store and transfer energy.

Figure 12:
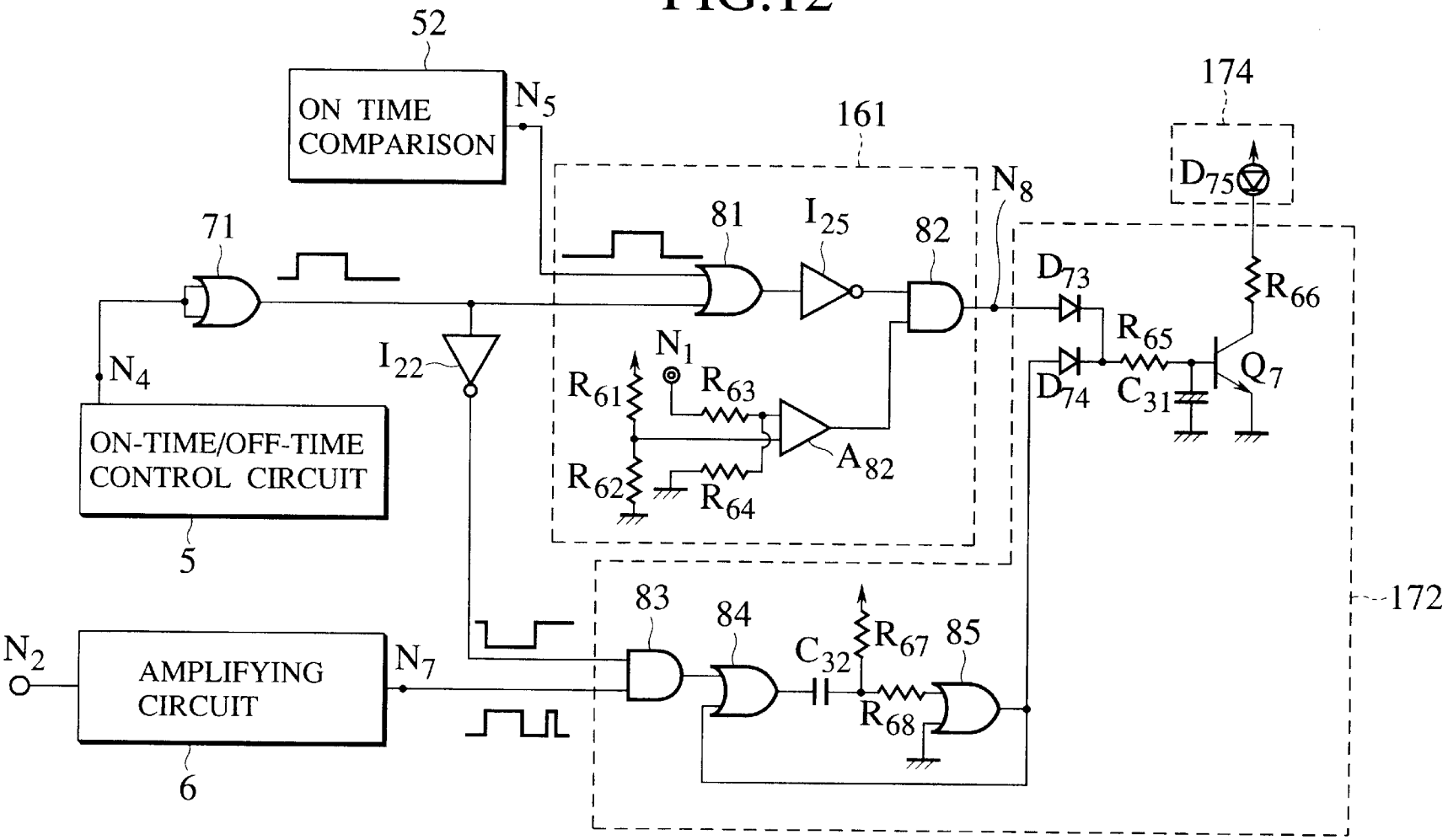
FIG. 12 is a diagram showing the circuit for detecting the upper limit of brightness in the brightness controller.

FIG. 12 shows an indicating unit 7 for detecting the lower limit of the OFF time $t_{OFF}$ and indicating the upper limit of brightness. This indicating unit 7 consists of a brightness upper limit detecting circuit 172 for detecting the upper limit of brightness and an indicating lamp 174, which is a light emitting diode $D_{75}$. The brightness upper limit detecting circuit 172 includes an AND circuit 83, which is supplied with the signal output from the ON-time/OFF-time control circuit 5 and inverted by the inverter $I_{22}$, and with the output from the SLVW amplifying circuit 6. If there is no spike peak $P_1$ near the trailing edge, the output from the AND circuit 83 is low, and therefore the bipolar transistor $Q_7$ is turned off. Consequently, the lamp 174 is turned off, indicating the upper limit of brightness. The brightness upper limit detecting circuit 172 is connected to an OFF-time waveform monitoring circuit 161 so that any abnormal vibration or the like generated on the OFF-time waveform can be indicated.

Figure 13:
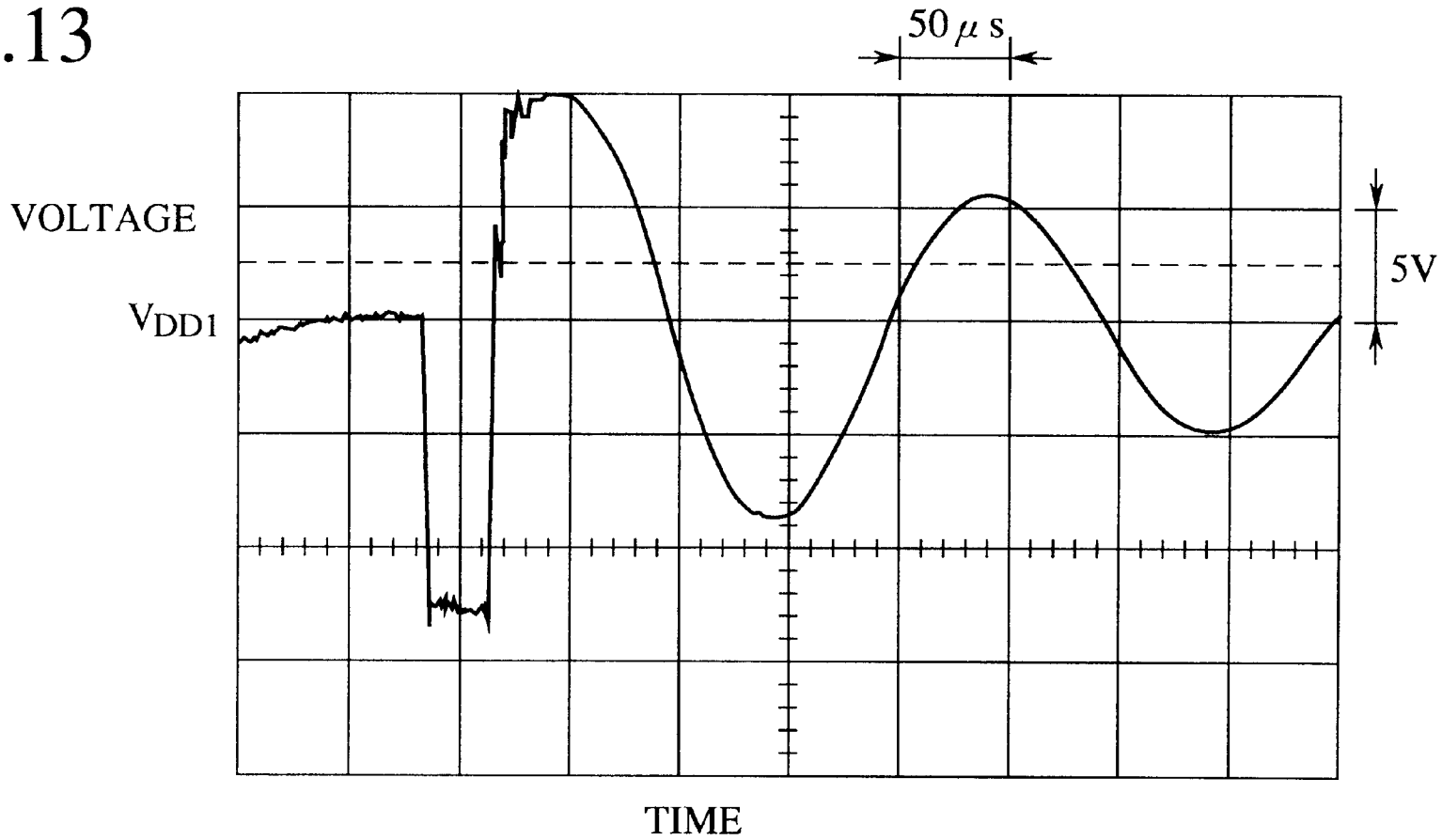
FIG. 13 is a chart showing the voltage output from the output element when the load impedance is too high.

Discharge tubes have various lengths and diameters, and differ in impedance. For higher load impedance, the supply voltage needs to be higher. FIG. 13 shows the second voltage waveform at the node $N_1$ which is output from the element 3 when the discharge tube 1 is too long. As shown in FIG. 13, if the load impedance becomes too high, an oscillation which has minimum values lower than the level of the supply voltage $V_{DD1}$ appears on the OFF-time waveform.

Figure 14:
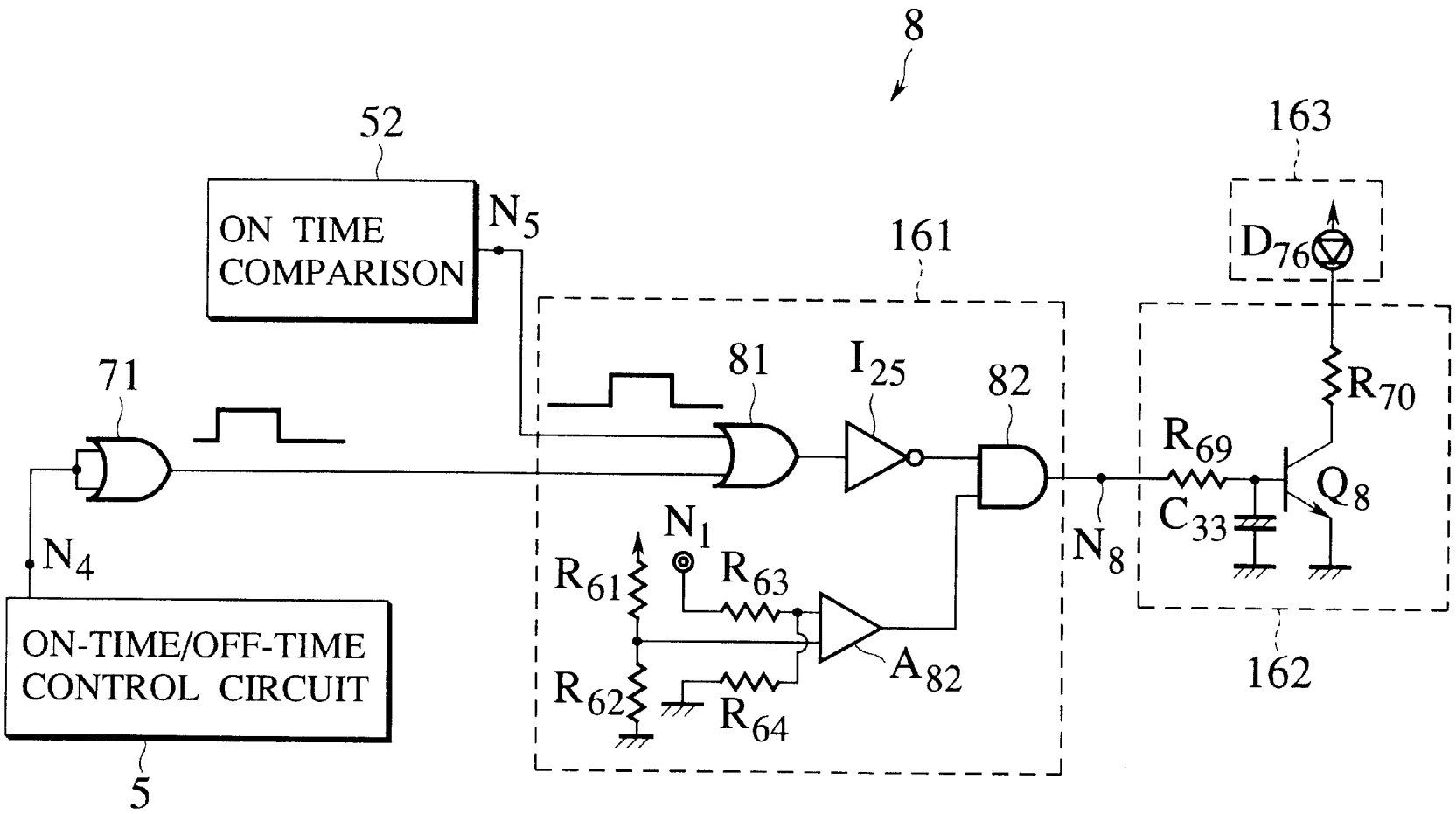
FIG. 14 is a diagram showing the load impedance indicating unit in the brightness controller.

FIG. 14 shows a load impedance indicating unit 8 for indicating such abnormal oscillation waveform ascribable to the too high load impedance. The indicating unit 8 consists of a load impedance indicating circuit 162 and an indicating lamp 163, which is a light emitting diode $D_{76}$. This circuit 162 includes an npn bipolar transistor $Q_8$. The base electrode of the transistor $Q_8$ can be supplied with a signal from the OFF-time waveform monitor 161 through a resistor $R_{69}$ and a capacitor $C_{33}$. The OFF-time waveform monitor 161 includes an AND circuit 82, which is supplied with the output voltage at the node $N_1$ and the voltage output from the ON-time/OFF-time control circuit 5 at the node $N_4$ and inverted by an inverter $I_{25}$. It is examined from the logical product by the AND circuit 82 whether there is abnormal oscillation on the OFF-time waveform.

Figure 15:
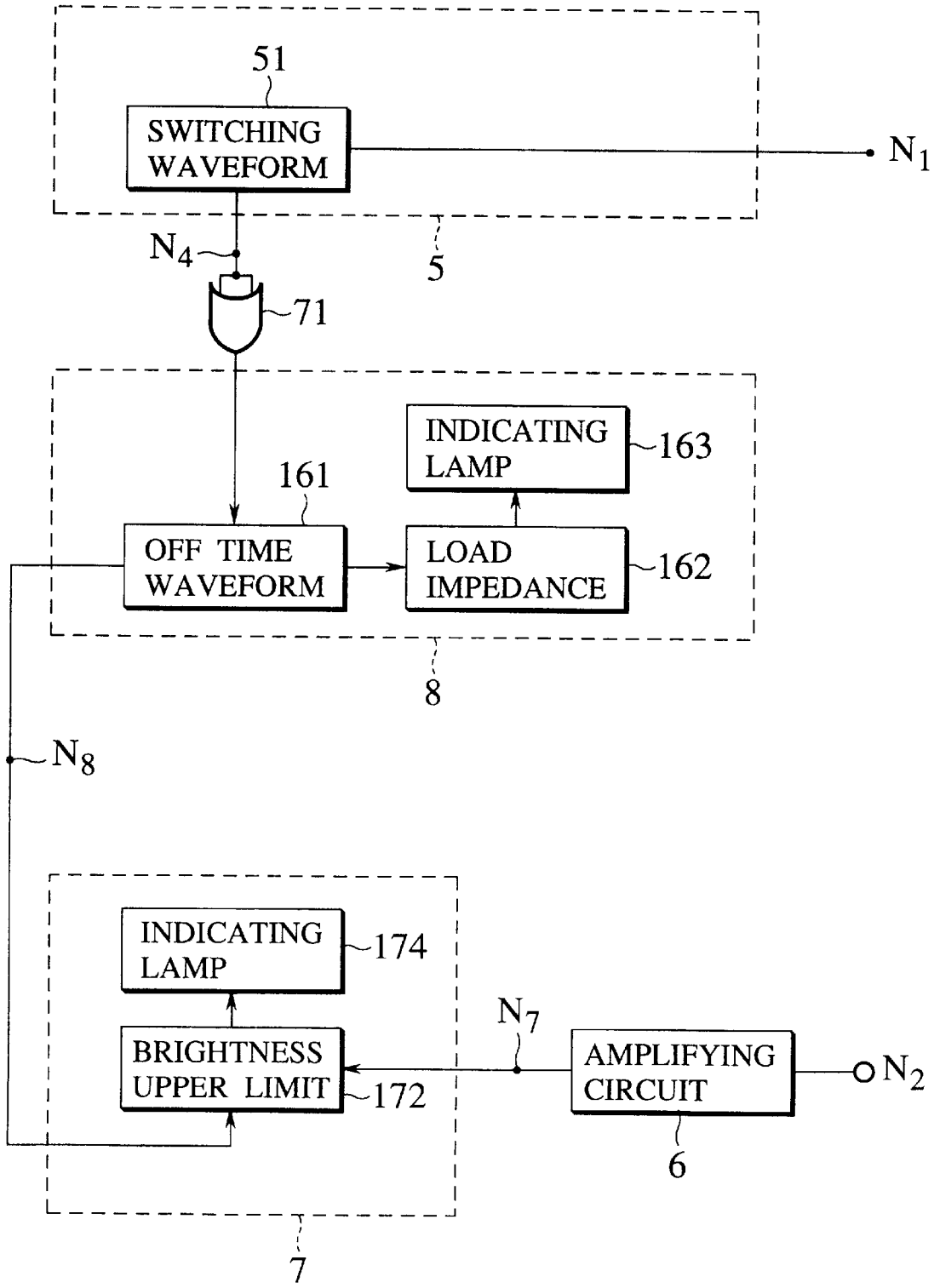
FIG. 15 is a block diagram showing the brightness upper limit indicating unit and the load impedance indicating unit in the brightness controller.

FIG. 15 is a block diagram showing the indicating unit 7 for indicating the upper limit of brightness, which is shown in FIG. 12, and the load impedance indicating unit 8, which is shown in FIG. 14.

Figure 16:
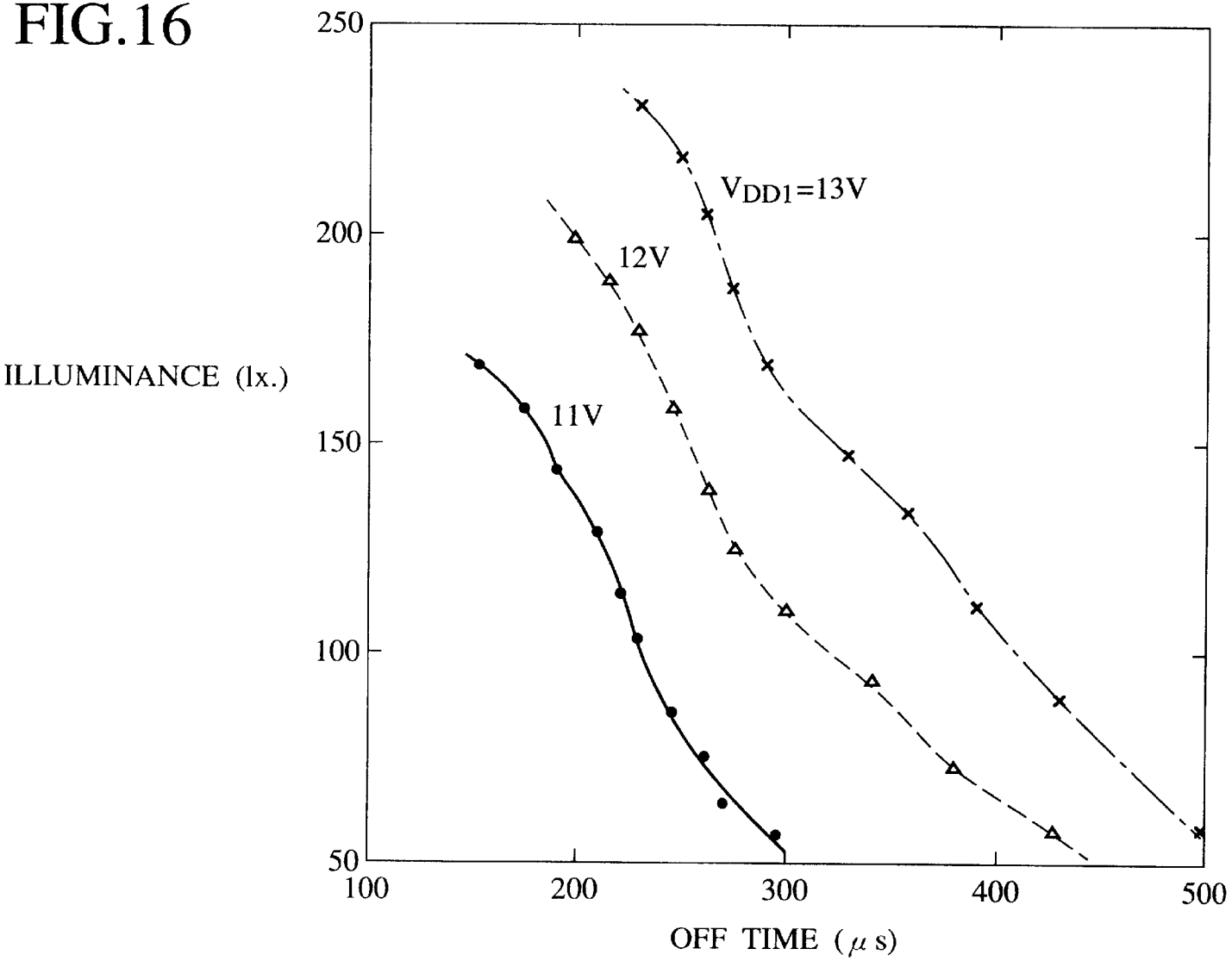
FIG. 16 is a chart showing the relationship between the OFF time and the illuminance of the discharge tube.
Figure 17A:
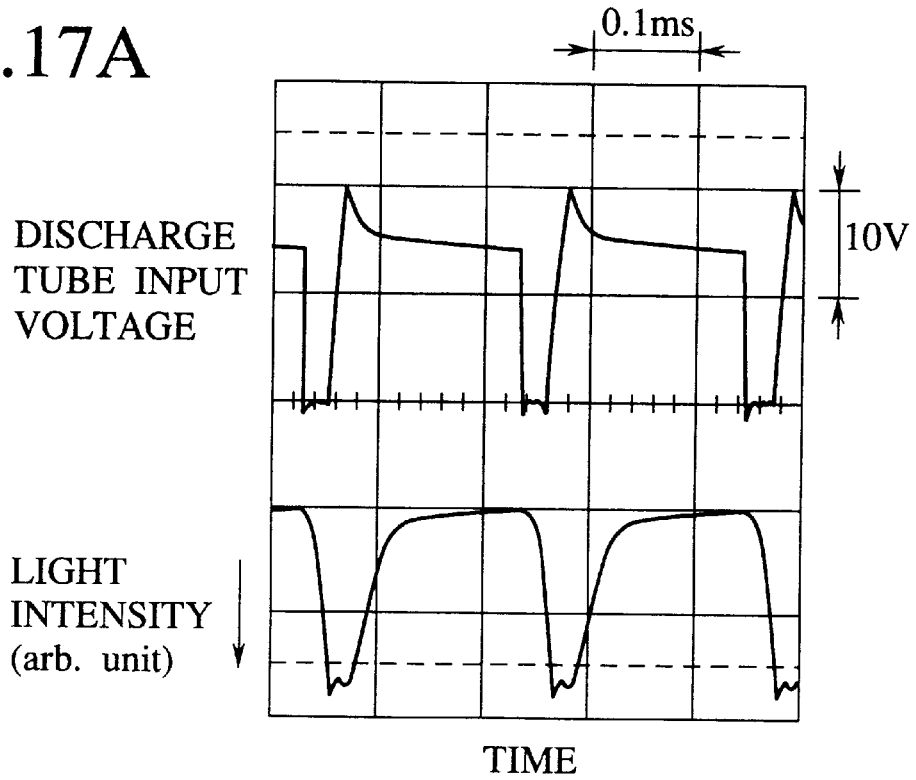
FIGS. 17A and 17B are charts showing the relationship between the voltage input to the discharge tube (the voltage output from the output element) and the light intensity of the tube.
Figure 17B:
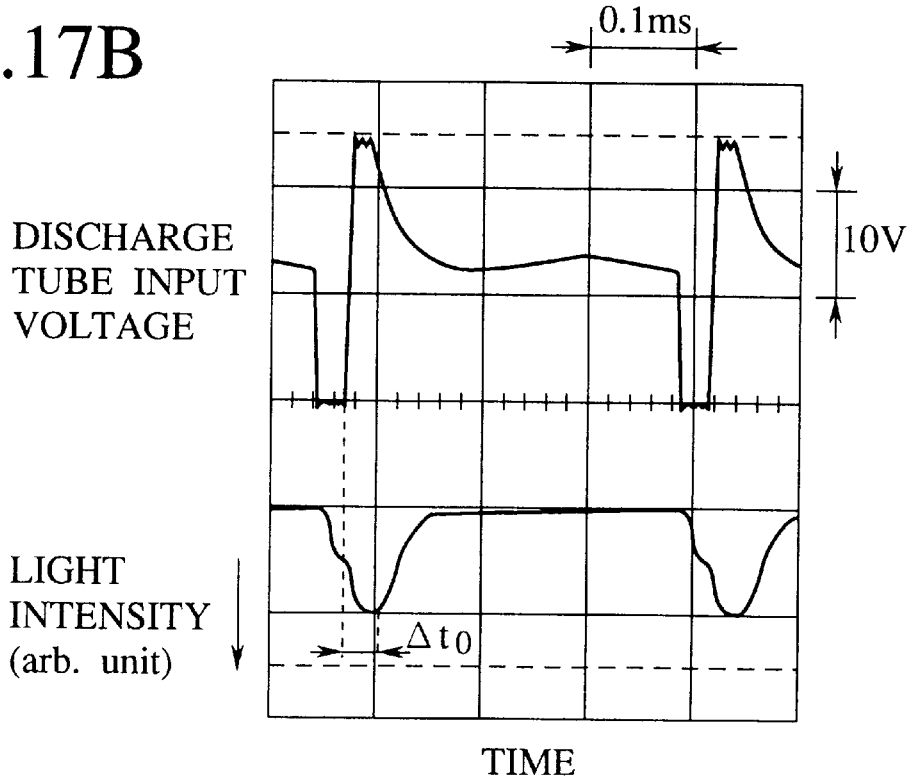
Figure 18:
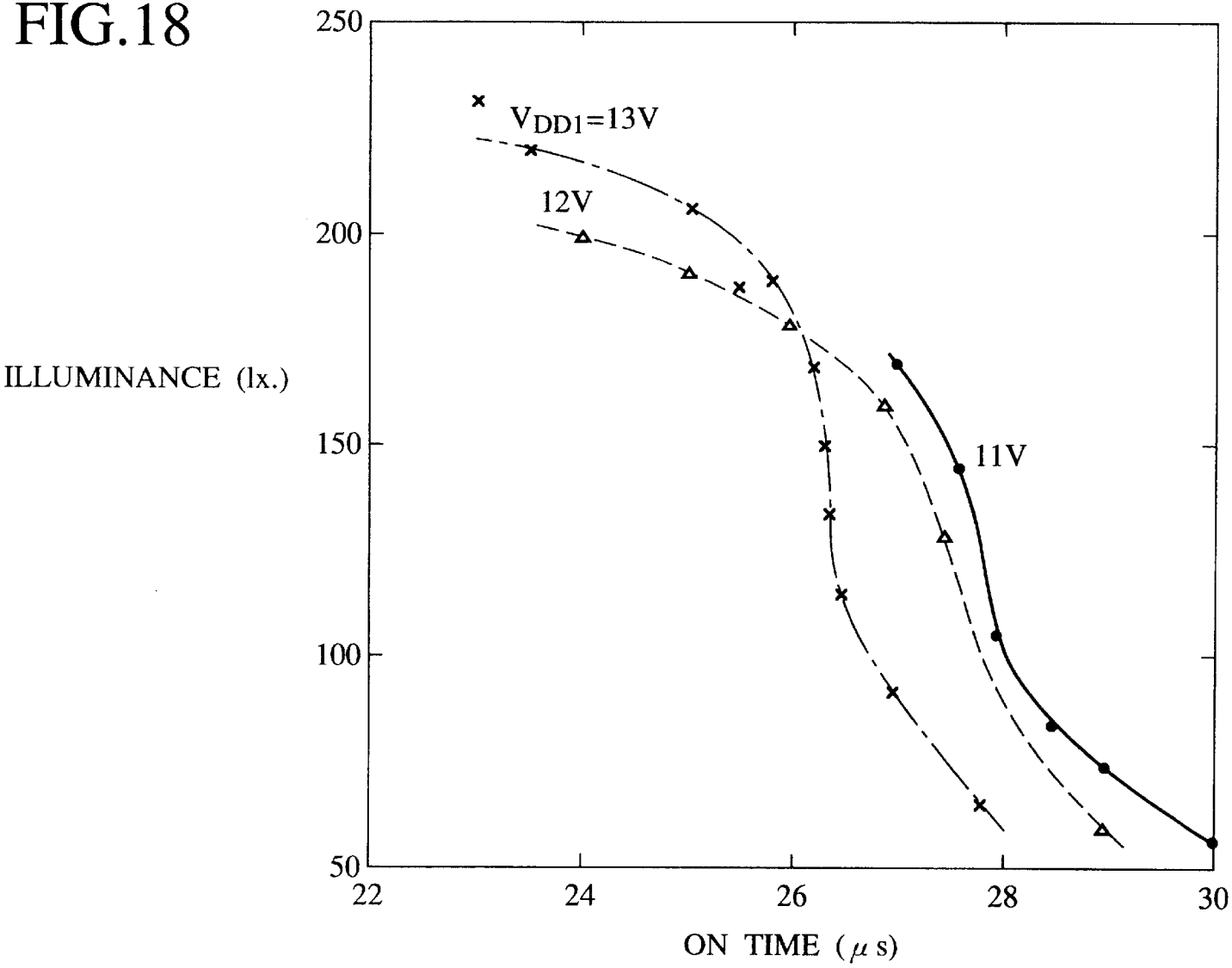
FIG. 18 is a chart showing the relationship between the illuminance of the discharge tube and the ON time.

FIG. 16 shows the relationship between the illuminance and OFF time of the brightness controller of the present invention for the supply voltages of 13, 12 and 11 volts of the power supply $V_{DD1}$ ($V_{DD1}$=13V, 12V, 11V). It is found from FIG. 16 that, as the OFF time lengthens, the illuminance lowers, and therefore the brightness of the discharge tube 1 can be adjusted.

It should be understood that the invention is not limited by the statements and drawings which form part of the description of the embodiment of the invention. From this disclosure, various modifications of the embodiment may be obvious to those skilled in the art. For example, the invention may be combined with a solar cell and battery system so that a solar cell may drive a neon tube display system. In such a case, the invention can save energy, and therefore reduces the burden on the solar cell and battery. As a result, it is possible to complete a display system emitting no carbon dioxide gas ($CO_2$), thereby solving the problem of the global warming due to the greenhouse effect. It is also possible to make color neon display which can adjust the chromaticity by comprising three neon tubes of red, green and blue, and adjusting freely the light emission intensity of each tube. It should be understood that the invention includes various embodiments not described herein. The invention is defined by the appended claims only.

What is claimed is:

1. A brightness controller for a discharge tube comprising:

a transformer including a secondary coil connected to the discharge tube and a primary coil having a first terminal connected to an electric power supply and a second terminal;

a capacitor directly connected between the first and the second terminals of the primary coil;

an output element having a control electrode and an output electrode connected to the second terminal of the primary coil;

a gate circuit connected to the control electrode for supplying a drive pulse to the control electrode;

an amplifying circuit connected to the first terminal of the primary coil for amplifying a first voltage pulse waveform at the first terminal of the primary coil, the amplifying circuit having a function of at least monitoring a distortion of the first voltage pulse waveform; and a control circuit connected between the gate circuit and the amplifying circuit for controlling an ON time and an OFF time of the drive pulses, the control circuit directly connected to the second terminal of the primary coil, wherein the maximum value of the ON time is determined according to the amplified first voltage pulse waveform at the first terminal of the primary coil, and the ON time and the OFF time are controlled independently of each other so as to adjust the brightness of the discharge tube.

2. The brightness controller of claim 1, wherein the amplifying circuit detects a spike peak at the end of the ON time of the first voltage pulse waveform, and decides the maximum value of the ON time of the drive pulses so as not to generate plural spike peaks at the end of the ON time.

3. The brightness controller of claim 1, wherein an optimum value of the ON time is decided by setting within a predetermined range the time difference between the trailing edges of a second voltage pulse waveform and the drive pulse waveform at the control electrode.

4. The brightness controller of claim 2, wherein an optimum value of the ON time is decided by setting within a predetermined range the time difference between the trailing edges of a second voltage pulse waveform and the drive pulse waveform at the control electrode.

5. The brightness controller of claim 2, wherein after an optimum value of the ON time is decided, the OFF time is decided for desired brightness while maintaining the optimum time of the ON time.

6. The brightness controller of claim 3, wherein after the optimum value of the ON time is decided, the OFF time is decided for desired brightness while maintaining the optimum time of the ON time.

7. The brightness controller of claim 4, wherein after the optimum value of the ON time is decided, the OFF time is decided for desired brightness while maintaining the optimum time of the ON time.

8. The brightness controller of claim 5, wherein the minimum value of the OFF time is determined by the output from the amplifying circuit so as not to eliminate the spike peak at the end of the ON time of the first voltage pulse waveform.

9. The brightness controller of claim 6, wherein the minimum value of the OFF time is determined by the output from the amplifying circuit so as not to eliminate the spike peak at the end of the ON time of the first voltage pulse waveform.

10. The brightness controller of claim 7, wherein the minimum value of the OFF time is determined by the output from the amplifying circuit so as not to eliminate the spike peak at the end of the ON time of the first voltage pulse waveform.

11. The brightness controller of claim 1, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

12. The brightness controller of claim 2, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

13. The brightness controller of claim 3, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

14. The brightness controller of claim 4, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

15. The brightness controller of claim 5, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

16. The brightness controller of claim 6, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

17. The brightness controller of claim 7, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

18. The brightness controller of claim 8, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

19. The brightness controller of claim 9, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

20. The brightness controller of claim 10, wherein the control circuit includes:

a switching waveform detecting circuit connected to the second terminal of the primary coil;

an ON time comparison circuit connected to the switching waveform detecting circuit;

an ON time reference circuit connected to the ON time comparison circuit;

an ON time adjustment circuit connected to the ON time reference circuit, for deciding an optimum value of the ON time;

an OFF time reference circuit connected to the ON time adjustment circuit and the ON time reference circuit;

a brightness adjustment circuit connected to the OFF time reference circuit, for deciding the OFF time.

21. The brightness controller of claim 2, wherein the second voltage pulse waveform comprises a substantially square wave.

22. The brightness controller of claim 21, wherein a supply voltage supplied by the electric power supply to the first terminal of the primary coil is adjusted so as not appear as an oscillating waveform after the trailing edge of the substantially square wave.

23. The brightness controller of claim 1, wherein the amplifying circuit comprises:

a capacitor directly connected to the second terminal of the primary coil;

an npn bipolar transistor having a base electrode directly connected to the capacitor; and an operational amplifier having an input terminal electrically coupled to a collector electrode of the npn bipolar transistor.

24. The brightness controller of claim 1, further comprising an indicating unit for detecting a lower limit of the OFF time including:

a detecting circuit connected to the amplifying circuit and to the control circuit through an inverter, for detecting the lower limit of the OFF time, having an AND circuit supplied with a signal output from the control circuit and with the output from the amplifying circuit; and an indicating lamp connected to the detecting circuit, for indicating an upper limit of brightness.

25. A method of controlling a brightness of a discharge tube connected to a secondary coil of a transformer, a primary coil of the transformer having a first terminal connected to an electric power supply and a second terminal connected to an output element, comprising the steps of:

(a) presetting an ON time of drive pulses supplied to a gate electrode of the output element to a predetermined value;

(b) setting the ON time to an optimum value by gradually lengthening the preset ON time while monitoring a voltage pulse waveform at the first terminal of the primary coil; and (c) adjusting an OFF time for the desired brightness while monitoring a voltage pulse waveform at the first terminal of the primary coil, maintaining the set optimum value of the ON time.

* * * * *